US005505680A

United States Patent [19]

Keith

[11] Patent Number: 5,505,680

[45] Date of Patent: Apr. 9, 1996

[54] ATHLETIC GRIP STRENGTH TRAINING DEVICE

[76] Inventor: Richard A. Keith, P.O. Box 3408, Ann Arbor, Mich. 48106

[21] Appl. No.: 270,606

[22] Filed: Jul. 5, 1994

[51] Int. Cl.[6] ..... A63B 21/00

[52] U.S. Cl. ..... 482/92; 482/148

[58] Field of Search ..... 482/92, 93, 148; 602/19, 65; 273/1.5 R, 1.5 A

[56] References Cited

U.S. PATENT DOCUMENTS

| | | | |
|---|---|---|---|
| 4,085,746 | 4/1978 | Castiglia | 602/65 |
| 4,621,811 | 11/1986 | Campbell | 273/1.5 A |
| 4,993,707 | 2/1991 | Schwartz | 273/1.5 A |

FOREIGN PATENT DOCUMENTS

| | | | |
|---|---|---|---|
| 2648704 | 12/1990 | France | 602/65 |

*Primary Examiner*—Lynne A. Reichard

[57] ABSTRACT

An athletic training device is described for improving the grip strength and exercising other muscle groups of the user, comprised of a single strap secured together at three separate junctions so as to form two large loops and a small loop, with a clasping mechanism attached to the small loop. A method for using the device is also described, in which a user secures a basketball within the device and attaches the clasping device to any of a number of existing resistance devices, such as wieght training machines with cable and pulley systems, free weights, elastic cords, springs and athletic training machines employing some form of these resistance devices.

10 Claims, 3 Drawing Sheets

ATHLETIC GRIP STRENGTH TRAINING DEVICE

BACKGROUND OF THE INVENTION

The invention concerns training and exercising devices used as aids in increasing the grip strength of a basketball player or other athlete engaged in a sport in which grip strength is an important element. Grip strength improvement is usually achieved by sessions on the basketball court practicing passing and rebounding, combined with general exercise, conditioning and strengthening programs. Heretofore it has been recognized that the execution of a physical skill is enhanced by the strengthening of the muscle groups involved in performing the skill. In recognition of this fact, exercising devices specifically directed to the development of the hand and wrist muscle groups have been devised. However, these prior exercise devices have not sufficiently simulated the basketball catch and rebound under resistance to be of maximum effectiveness in developing grip strength, specifically in regards to the hand, fingers, arm and shoulder muscles. It would be most useful if such exercise devices closely simulated the catch and rebound motions themselves such as to contribute to the process of increasing strength through repetition with resistance.

Therefore, it is an object of the present invention to provide a basketball training and exercise device which in use closely simulates the catch and rebound motions, such as to develop the precise muscle groups in the fingers, hand, wrist, arm and shoulders necessary to execute the basketball catch and rebound so as to develop those muscles groups and thereby improve basketball grip strength.

It is a further object to provide a basketball training device which in use closely approximates the execution of the catch and rebound motions such that its use also contributes to the physical learning process.

SUMMARY OF THE INVENTION

These and other objects of the present invention are achieved by a basketball training device comprising a strap with a constant width ranging from approximately ½ inch to 2 inches configured in the shape of a "figure eight" with a separate small loop at the top of the "figure eight". The two larger loops have a perimeter measurement of approximately twenty seven inches and the small loop has a perimeter measurement of 8 to 20 inches. A clasping device, such as a snap hook, is attached to the separate small loop to provide a means with which to attach the training device to a source of resistance, such as a weight machine.

The device may be used by spreading it on a flat surface, placing a basketball on top of the center of the "figure eight", and wrapping the hook end over the top of the basketball. The other (non-hook) end of the device is then also placed on top of the basketball such that it overlaps the hook end. The device and basketball can then be lifted by the hook from the flat surface wherein the weight of the basketball pulls the device taut so as to secure the basketball in the device. With the basketball hanging in the device, the longitudinal straps are arranged so that they are equally spaced radiating around the circumference of the ball so that the weight is distributed evenly over the surface of the ball in order to stabilize the ball in the device. Any force on the hook directed away from the basketball or any force on the basketball directed away from the hook will keep the harness taut and the basketball secure. The device is then hooked to any of a number of aforementioned resistance devices, such as a weight machine. It will also be appreciated that the invention provides tremendous flexibility in training in that it is easily portable (it may also be used separately as a basketball carrying device) and may be quickly and easily connected to virtually any appropriate resistance device.

BRIEF DESCRIPTION OF THE DRAWINGS

The foregoing advantages of the present invention are apparent from the following detailed description of the preferred embodiment of the invention with reference to the drawings, in which.

PREFERRED EMBODIMENT OF THE INVENTION

Figure 1:
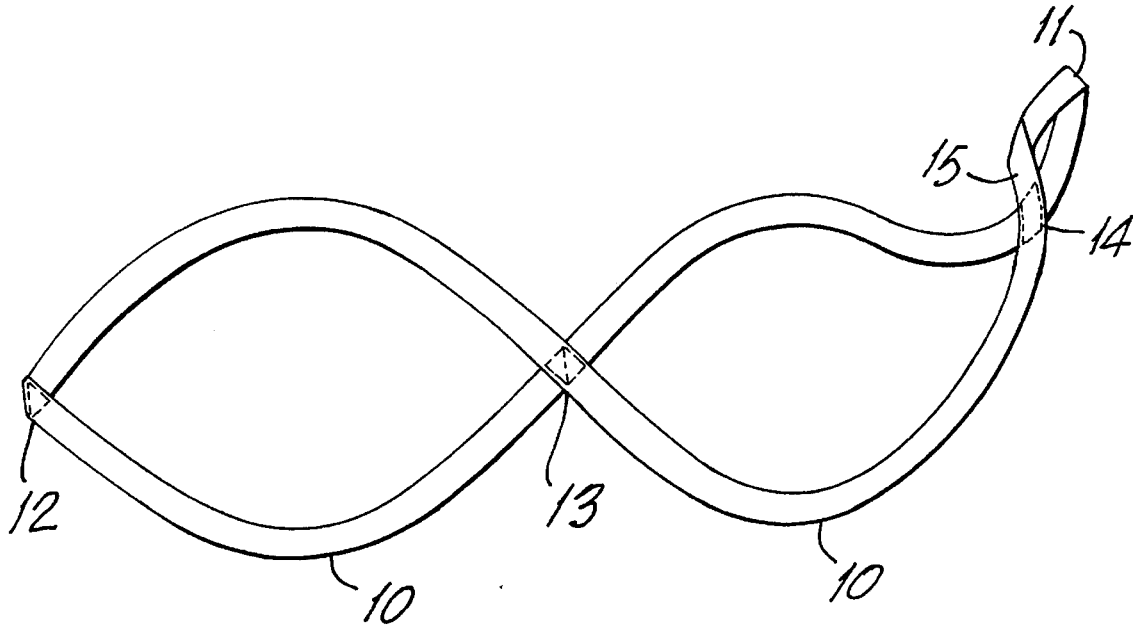
FIG. 1 shows the basketball training device, including a harness of nylon strap attached in the shape of a "figure eight" with a hook secured to one end of the device.

Referring to FIG. 1, the preferred embodiment of the invention is made from a single piece of narrow nylon strapping one inch wide and 73¼ inches long 10, and a sturdy clasping device, such as a snap hook 11. When in use, the strap follows the topographical features of the basketball keeping a low profile so as not to unduly inhibit contact between the fingertips of the user and the basketball's surface.

The preferred embodiment is constructed by first folding the strap over onto itself approximately 15¾ inches from a first end of the strap, thereby forming a triangular overlap 12 in which the strap intersects itself to form a fight angle and is secured by stitching through the fold overlap. The sewn stitches follow the triangular shape of the overlap.

The first end of the strap is then secured to a point 13 which is 15½ inches further along the strap from the triangular fold, by stitching made from nylon or similar high strength stitching material capable of withstanding a force of at least 50 pounds, and as much as several hundred pounds. The two sections of the strap are perpendicular at the junction. The stitches follow the square perimeter of the overlap and must be capable of withstanding a force of at least 50 pounds.

A third joint 14 is foraged by overlapping the strap at a point that is approximately 16 inches further along the strap from the junction just described with the point approximately 26 inches further along the strap. The overlap at this junction is joined to form an angle of approximately thirty degrees and the junction is sewn around the perimeter of the overlap. This union forms a separate small loop 15 at the top of the "figure eight".

After the "figure eight" and the small loop have been formed, the end of the remaining length of strap, approximately 16½ inches, is sewn to the point of the first junction 13, so as to form the center of the "figure eight". Again, the junction is sewn around the perimeter of the overlap.

A 3¼ inch steel spring hook with a one inch gate 11 is secured to the small loop at one end of the "figure eight". This hook is used to attach the device with basketball to a resistance device, such as free weights, elastic cords, springs and athletic training machines employing some form of these resistance devices.

Figure 2:
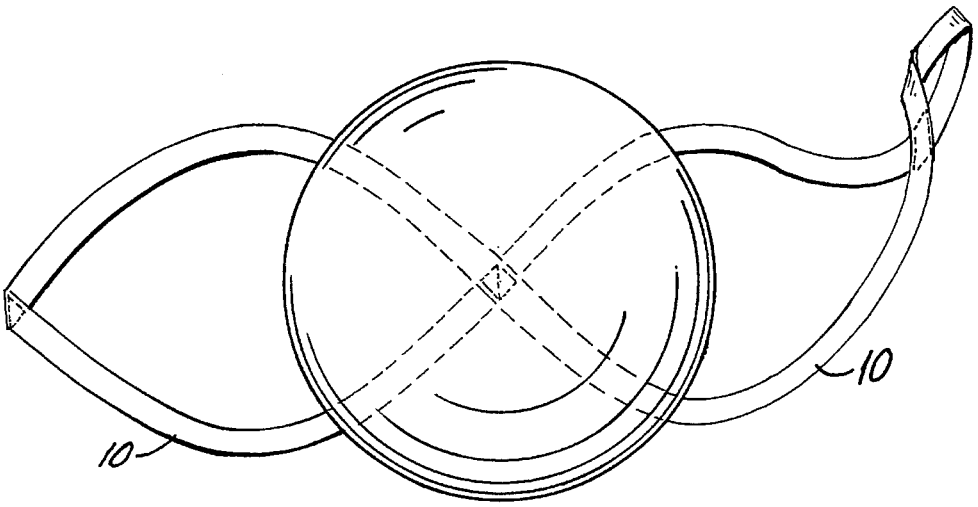
FIG. 2 shows the first step in securing a ball in the basketball training device in which the device is spread on a planar surface with a basketball placed at the center of the "figure eight".
Figure 3:
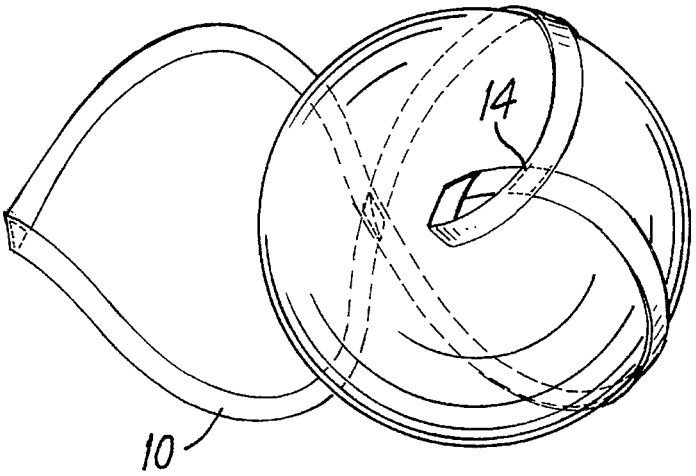
FIG. 3 shows the second step in securing a ball in the device in which the hook end of the device is partially wrapped around the circumference of the basketball.
Figure 4:
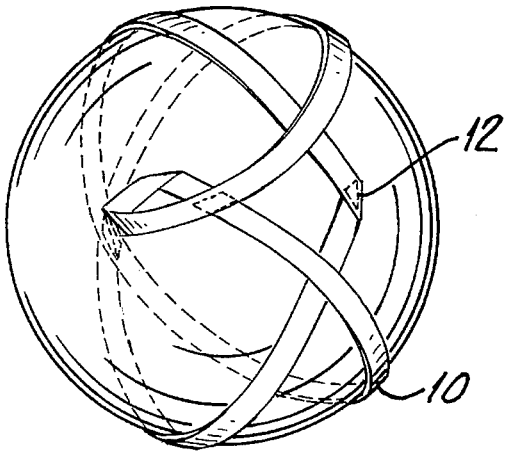
FIG. 4 shows the third step in securing a ball in the device in which the second end of the device is wrapped over the hook end and thereby fastened around the circumference of the basketball.
Figure 5:
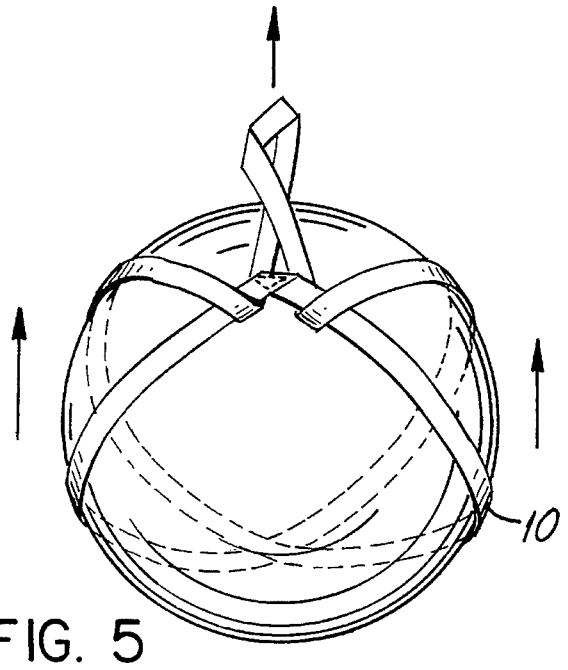
FIG. 5 shows the basketball suspended securely in the device.
Figure 6:
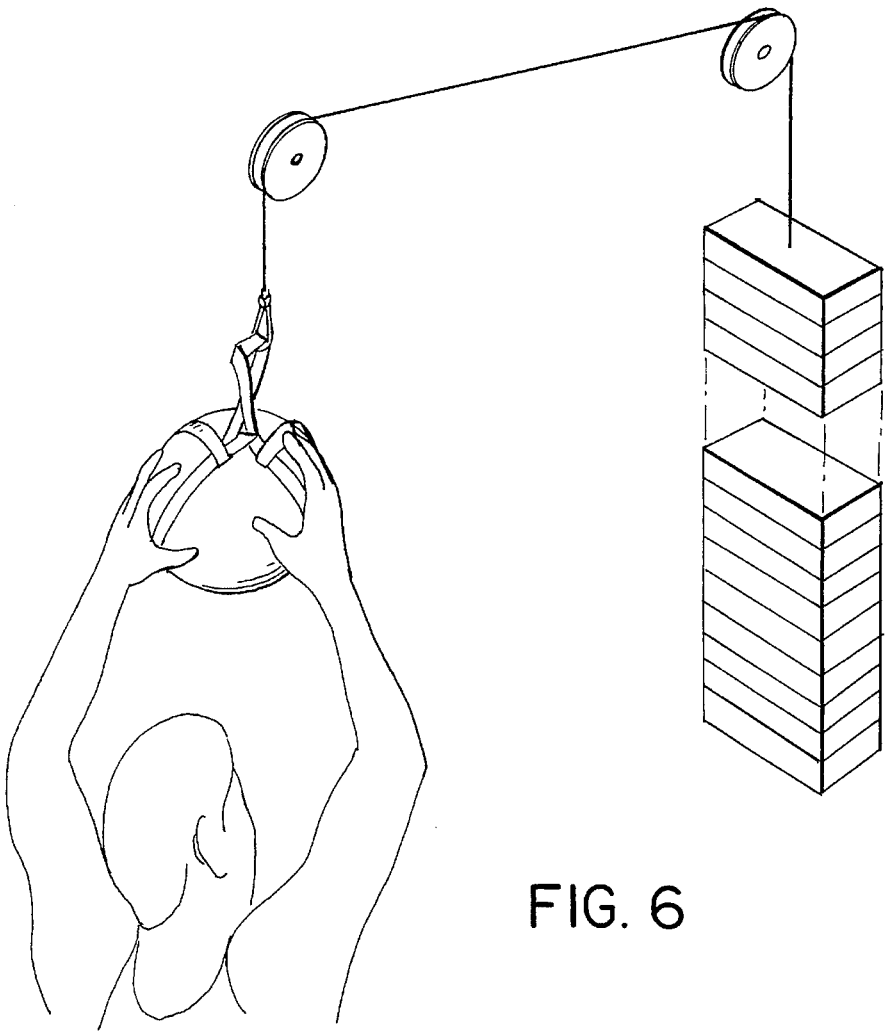
FIG. 6 shows the device being used with a weight training machine with cable and pulley.

Referring to FIG. 2, the preferred embodiment of the invention is used by first placing the device on a flat surface and placing a basketball or suitable substitute directly on top of the junction at the center of the "figure eight". Referring to FIG. 3, the hook end of the device 14 is then wrapped about the circumference of the basketball to a point approximately opposite the junction at the center of the "figure eight". Referring to FIG. 4, the first junction at opposite end of the device 12 (with the triangular overlap) is then wrapped firmly around the circumference of the basketball such that it overlaps the hook end of the device. Referring to FIG. 5, the device is made taut so as to secure the basketball by lifting the device by the hook 15. Because of the "figure eight" construction of the device, it forms four sections spaced equidistant from each other while securing a basketball such that any force applied, whether from the hook end of the device or by pulling the basketball in the opposite direction, is evenly dispersed around the basketball. FIG. 6 shows the device in use by attachment to a cable and pulley system on a weight machine.

It will be appreciated that certain variations to the device may be made without altering the essential character of the invention. While a strap of one inch width is used in the preferred embodiment, a width of as small as ½ inch or wider than two inches may also be used. In particular, if the invention is used with balls used in other sports, such as a volleyball or water polo ball, a smaller or larger width strap may be used as appropriate. Other materials may be substituted for the nylon strap so long as such materials have strength and flexibility properties similar to nylon. Similarly, the dimensions of the device may be increased or decreased so long as the relative proportions of the "figure eight" remain approximately the same. The 3¼ inch steel spring hook may be replaced by a hook of smaller or larger dimension or of different material, such as plastic, so long as the clasping device is capable of withstanding a force of at least 50 pounds.

I claim:

1. An athletic training device for use in connection with a resistance device, comprising:

a single strap fastened together at a first, second and third junction so as to form two contiguous large loops of approximately equal size, which large loops form a figure eight shape, and a small loop; and a clasping mechanism attached to the small loop;

the strap is in the 72 to 75 inches in length;

the first junction is secured by folding the strap onto itself at a right angle at a point 15¾ inches from a first end of the strap and stitching the strap together at the first junction;

the second junction is secured by folding the first end of the strap onto itself at a point on the strap 15½ inches from the first junction and stitching the strap together at the second junction;

the third junction is secured by folding the strap onto itself at a first point 16 inches from the second junction and a second point 26 inches from the second junction, and stitching the strap together at the third junction, so as to form the small loop;

a second end of the strap is stitched to the first junction.

2. The athletic training device in claim 1 wherein the clasping mechanism is a 3¼ inch steel spring hook with a one inch gate.

3. The athletic training device in claim 1 wherein the clasping mechanism is composed of plastic.

4. The athletic training device in claim 1 wherein the first, second and third junctions, and the clasping mechanism, are each capable of withstanding a pull force of fifty pounds.

5. A method of using an athletic training device, the device comprising a single strap fastened together at a first, second and third junction so as to form two contiguous large loops of approximately equal size, so as to form a figure eight shape, and a small loop, and a clasping mechanism attached to the small loop, the method comprising the steps of:

placing the athletic training device on a relatively flat surface;

placing a basketball on the athletic training device centered at the second junction;

wrapping the small loop with the clasping mechanism over the surface of the basketball;

wrapping the athletic training device over the surface of the basketball such that the second junction is folded over the clasping mechanism attached to the small loop;

grasping the clasping mechanism and raising the athletic training device so as to tighten the device about the circumference of the basketball;

attaching the clasping mechanism to a resistance device; and exercising by grasping and pulling the basketball against the resistance of the resistance device.

6. The athletic training device in claim 5 wherein the resistance device comprises a weight machine with a cable and pulley system.

7. The athletic training device in claim 5 wherein the resistance device comprises a free weight.

8. The athletic training device in claim 5 wherein the resistance device comprises an elastic cord.

9. The athletic training device in claim 5 wherein the resistance device comprises a spring device.

10. The athletic training device in claim 1 wherein resistance is provided by a second person.

* * * * *